US005117913A

United States Patent [19]

Themig

[11] Patent Number: 5,117,913

[45] Date of Patent: Jun. 2, 1992

[54] CHEMICAL INJECTION SYSTEM FOR DOWNHOLE TREATING

[75] Inventor: Daniel J. Themig, Oklahoma City, Okla.

[73] Assignee: Dresser Industries Inc., Dallas, Tex.

[21] Appl. No.: 589,056

[22] Filed: Sep. 27, 1990

[51] Int. Cl.[5] ..... E21B 41/02

[52] U.S. Cl. ..... 166/310; 166/129; 166/183; 166/332; 166/902

[58] Field of Search ..... 166/310, 312, 373, 386, 166/387, 129, 133, 183, 332, 334, 902

[56] References Cited

U.S. PATENT DOCUMENTS

| | | | |
|---|---|---|---|
| 2,798,558 | 7/1957 | McCulloch | 166/183 |
| 3,186,483 | 6/1965 | Schwab | 166/129 |
| 3,493,052 | 2/1970 | Evans et al. | 166/332 |
| 3,548,946 | 12/1970 | Engle | 166/310 |
| 4,031,955 | 6/1977 | Ledet | 166/902 |
| 4,280,561 | 7/1981 | Fredd | 166/332 |
| 4,326,585 | 4/1982 | McStravick | 166/310 |
| 4,573,529 | 3/1986 | Reinhardt | 166/68 |
| 4,749,036 | 6/1988 | Read | 166/902 |

*Primary Examiner*—Bruce M. Kisliuk

[57] ABSTRACT

A chemical injection assembly and apparatus for treating production fluids in a bore-hole. The system includes a fixed packer having an opening passing therethrough for receiving a production tubing string, a closable orifice in the packer that is actuated by the tubing string and appropriate seals for preventing fluid transfer within the packer. When the tubing string is inserted into the packer, a collar on the tubing string engages a shiftable sleeve that places an orifice in the shifting sleeve in alignment with the orifice in the injection sleeve so that chemical treatment fluid from the surface can be forced down the bore-hole casing through the closable orifice in the packer and into the production fluid at the perforations near the producing formations. The treated fluids then enter the tail pipe of the packer and up the tubing string to the surface. When it is desired to plug the well, a plug is inserted into the tail pipe and the tubing string is withdrawn. As the tubing string is withdrawn, the collar on the tubing string engages a collar on the shiftable sleeve moving it to a second position where it blocks the orifice in the injection sleeve thus preventing any transfer of fluid from below the packer to the well casing above the packer.

15 Claims, 2 Drawing Sheets

CHEMICAL INJECTION SYSTEM FOR DOWNHOLE TREATING

FIELD OF THE INVENTION

The present invention relates to a chemical treatment of production fluids in a bore-hole and it specifically relates to a packer that can be used to block a bore-hole casing while allowing chemical treatment fluids to be injected below the packer in the area of the casing perforations producing the production fluids and still allow a plug to be set by wire-line in the tail pipe so that the well is completely plugged when the tubing and seal assembly are removed.

BACKGROUND OF THE INVENTION

It is well known in the art that in the petroleum industry, certain wells that are drilled produce highly corrosive fluids or high pressure fluids that can damage the casing that is set in the well bore. The perforations in the casing in the area of the producing formations allow the corrosive production fluids to enter the casing. It is desirable in such cases, however, to introduce a packer into the casing above the perforations to seal off the upper portion of the casing from the corrosive or high pressure fluids. In such case, a production tubing string is placed within the bore-hole casing and through an opening in the packer so that the production fluids can enter the production tubing below the packer and be carried to the surface without coming in contact with the casing above the packer.

It is important in such types of wells that the fluid be treated, if it is corrosive, so it will not adversely affect the production tubing carrying the corrosive fluid to the surface. This is normally accomplished with a chemical injection valve as part of the production tubing just above the packer in the bore-hole. The treatment fluid is then pumped down the tubing/casing annulus, or through a conduit that is connected to the chemical injection valve. When sufficient pressure is applied to the chemical carrying conduit or tubing/casing annulus, the injection valve opens and the chemicals are introduced into the production tubing above the packer to treat the fluid that is going through the production tubing to the surface.

Clearly, however, this does not treat the corrosive fluid below the packer that is engaging the well bore casing, the tail pipe and the extensions coupled to and below the packer. The packer, however, allows the use of a wire-line set plug in the tail pipe for leaving the well plugged when the production tubing and seals are removed. Again, however, there is no way to treat the production fluid below the packer with the prior art system; thus the casing and pipe extension below the packer are subjected to the corrosive influence of the fluid.

If the packer is not used, the well can be treated all the way to the bottom of the casing in the area of the perforations. However, if it is desired to plug the well, it cannot be done since a packer has not been used in the well. Thus, in the prior art one can use the packer and plug off the well and treat the corrosive fluid above the packer but cannot treat the production fluid below the packer. The other option is to treat the fluid all the way to the bottom of the casing without the ability to plug off the well because there is no packer.

The present invention allows the use of a packer to plug off the well but still enables the production fluid to be treated below the packer to preserve the casing in the area of the casing perforations where the production fluid is being generated as well as the casing, the tail pipe and the pipe extensions below the packer. With the present invention, treating chemicals or water can be placed below the production packer outside the tail pipe by following passageways through the production packer so that it will wash by the perforations in the well-bore casing where the production fluids are being generated and protect the casing, the tail pipe and the packer extensions that are below the packer. It can also accommodate a wire-line set plug in the tail pipe for plugging the well and when the tubing and seals are removed, the passageways through the production packer for the chemical treatment are closed to complete the plugging of the well. In order to accomplish the present system, the production packer is used to block production fluid flow from the casing perforations below the packer in the area of the producing formations to the casing above the packer. A tubing string is placed inside the casing and coupled to and sealably extended through an opening in the blocking packer. Because the packer prevents the production fluid from rising in the casing beyond the packer, the tubing means that is coupled to and extends through the blocking packer enables production fluid to flow from the formations through the perforations in the casing and through the tubing string to the surface. The tubing string and the packer prevent the corrosive production fluids from attacking the well-bore casing above the blocking packer. A chemical injection sleeve is associated with the tubing string and the blocking packer to allow the chemical treatment fluid to flow through the blocking packer to the perforations in the casing below the packer for treatment of the production fluid which then returns to the surface through the tail pipe, packer extensions and the tubing string.

An orifice is formed in the injection sleeve below the blocking packer to allow the chemical treatment fluid to enter the well-bore casing below the blocking packer in the vicinity of the perforations to treat the production fluids. A shifting sleeve is formed concentric with the inside circumference of the injection sleeve and is movable between first and second positions. An orifice in the shifting sleeve is in alignment with the orifice in the injection sleeve in the first sleeve position such that chemical treatment fluid may flow between the tubing means and the shifting sleeve through the aligned orifices and to the production fluids being generated by the perforations in the casings. The treated fluids, as stated earlier, then are carried to the surface by the tubing string.

A shifting collar is formed on the tubing means and has a first shoulder on the shifting collar for moving the shifting sleeve to its first position aligning the injection sleeve orifice and the shifting sleeve orifice when the tubing means is first inserted in the blocking packer. A second means in the form of a second shoulder on the shifting collar moves the shifting sleeve to its second position blocking the injection sleeve orifice when the tubing sleeve is withdrawn from the blocking packer. The first and second shoulders on the shifting collar engage corresponding third and fourth shoulders on the shifting sleeve. The first shifting collar shoulder engages the third shifting sleeve shoulder when the tubing means is inserted into the injection sleeve and moves the shifting sleeve to its first position aligning the orifices in the shifting sleeve and the injection sleeve. The second shifting collar shoulder engages the fourth shifting sleeve shoulder when the tubing means is withdrawn from the blocking packer to move the shifting sleeve to its second position blocking the injection sleeve orifice. A flange is used to form the fourth shoulder on the shifting sleeve and a flange receiving groove is formed on the inner surface of the injection sleeve for receiving the flange in the second position of the shifting sleeve. This relationship creates space sufficient to enable the shifting collar to bypass the flange when the tubing means is inserted in or removed from the injection sleeve and the blocking packer. The flange is forced out of the groove when the shifting sleeve is moved to the first position by the shifting collar. First and second spaced annular sealing rings are formed on the same side of the orifice in the shifting sleeve and are in sealing contact with the injection sleeve. The first and second spaced sealing rings are located on respective sides of the orifice in the injection sleeve when the shifting sleeve is moved to the second position and thus seal the injection sleeve orifice. The seals prevent a transfer of the treated fluid to the interior of the injection sleeve when the tubing string is removed from the casing.

Thus, it is a principal object of the present invention to provide apparatus including an injection sleeve with an orifice therein for placing fluid treating chemicals or water below the production packer and outside the tail pipe to wash by the perforations generating the production fluid while at the same time accommodating a wire-line set plug in the tail pipe such that when the tubing string and its seals are removed, the orifice in the injection sleeve will close to complete the plugging of the well.

It is still a further object of the present invention to provide a shifting sleeve in the packer which moves to a first position to open an orifice in an injection sleeve when the tubing string is first inserted into the packer to allow chemical treatment of the fluid below the packer. The shifting sleeve is moved to its first position by a shifting collar on the tubing string that engages the shifting sleeve during the positioning of the tubing string in the packer. The shifting sleeve is shifted to its second position by the shifting collar to close the orifice when the tubing string is removed from the packer. When the orifice is open, the injection sleeve allows treating fluids or treating chemicals to be placed below and outside the packer. When the tail pipe is plugged and the injection sleeve orifice is closed, the well is plugged.

SUMMARY OF THE INVENTION

Thus the present invention relates to a system for chemical fluid treatment of production fluids as they are produced by perforations in a well-bore casing and carried to the surface. This system comprises a packer for blocking production fluid flow in the casing from the perforations and a tubing string inside the casing and coupled to and extending through the blocking packer for enabling the production fluid to flow from the perforations through the tubing string to the surface. The tubing string and blocking packer prevent the production fluids from contacting the well-bore casing above the blocking packer. An injection sleeve having an orifice therein is associated with the tubing string and the blocking packer for allowing chemical treatment fluid to flow between the blocking packer and the tubing string and through the injection sleeve orifice to the perforations for treatment of the production fluid that is returning to the surface through the tubing string.

The invention also relates to a method of chemically treating production fluid from perforations in the well casing in a bore hole and comprises the steps of blocking the production fluid flow in the casing above the perforations with a packer, conducting the production fluid from the perforations to the surface of the bore hole through production tubing that extends through a passage way in the packer and chemically treating the production fluid in the area of the perforations through a selectively closeable orifice in the packer.

The invention also relates to a chemical injection system for a well-bore comprising a production casing, perforations in the casing for receiving production fluids from the well-bore, a production packer positioned in the casing above the perforations, a first injection sleeve attached to the lower end of the packer with a space between the sleeve and the casing, at least one first orifice in the injection sleeve for allowing chemical treatment fluids to enter the space between the injection sleeve and the casing to mix with the production fluids, a second sleeve slidably concentric with and abutting the inside surface of the first injection sleeve, at least one second orifice in the second sleeve for movement between a first position in aligned relationship with the first orifice and a second position out of alignment with the first orifice. First and second spaced seals are on the second slidable sleeve for movement between a first position remote from the first orifice and a second position for sealing the first orifice from the chemical treatment fluid. A recess is formed on the inner surface of the first injection sleeve and a spring-loaded collet or fourth shoulder is integrally formed with the second slidable sleeve for latching engagement with the recess. A third shoulder is formed on the other end of the second slidable sleeve for engagement with a tubing string inserted in the well-bore and the first injection sleeve. A collar on the tubing string has a first shoulder that engages the third shoulder on the second slidable sleeve when moving into the bore-hole for moving the second slidable sleeve and causing the first and second orifices to align and allow the chemical treatment fluid to pass therethrough. The collar on the tubing string has a second shoulder that engages the slidable sleeve collet when moving out of the bore-hole to shift the second sleeve to its second position and seal the orifice in the injection sleeve.

The invention also relates to a packer for enabling blocking of a bore-hole casing, allowing a production tubing string to extend into a passageway in the packer for recovering production fluid from perforations in the casing, and enabling treatment of the production fluid in the area of the perforations. The packer comprises a hollow center portion for positioning in the bore-hole casing at a predetermined depth. A substantially cylindrical chemical injection sleeve is attached to and extends downwardly from the hollow center portion and has a first orifice therein. A slidable sleeve is concentrically arranged on the inside surface of the injection sleeve for movement between a first and second position and has a second orifice therein. At least one recess is formed on the inner wall of the injection sleeve and at least one resilient projection forms a part of one end of the shifting sleeve and rests in the recess when the shifting sleeve is in the second position. The projection rests resiliently on the inner wall of the injection sleeve when the shifting sleeve is in any position other than the second position and is used in moving the shifting element to the second position. A second projection forms a part of the other end of the shifting sleeve and is used in moving the shifting sleeve to its first position. The first orifice in the injection sleeve and the second orifice in the shiftable sleeve are in alignment only when the shifting sleeve is in the first position thus allowing the chemical treatment fluid to pass through the aligned orifices to the production fluid in the area of the perforation in the casing.

BRIEF DESCRIPTION OF THE DRAWINGS

These and other objects, advantages and features of the present invention will be apparent on consideration of the following detailed description thereof taken in conjunction with the accompanying drawings in which like numbers represent like elements and in which.

DETAILED DESCRIPTION OF THE DRAWINGS

It is well known in the petroleum industry that certain wells produce fluids that are highly corrosive and tend to quickly corrode and destroy the well casing and other metal components that are used down hole. In order to counteract the effects of the corrosive fluids, the wells are chemically treated to protect the pipes handling the fluid. The production casing has perforations therein in the vicinity of the producing formations so that the fluid produced can enter the perforations and travel up the casing to the surface. If the fluid produced is corrosive, it is important to chemically treat the fluid to counteract the corrosive effects on the casing and it is important of course to treat the fluid in the vicinity of the producing perforations so that the entire casing is protected. It is also important to be able to plug the well if need be.

If the well is not going to be plugged, then the chemicals can be injected at the bottom of the well casing to treat all of the fluids within the casing. However, if the well is to be prepared such that it can be plugged as needed, then a packer must be inserted within the casing. With the packer placed in the well casing, it is not possible in the prior act to treat the fluid in the well casing below the packer thus exposing the pipes below the packer to the corrosive effects, if any, of the production fluid.

Figure 1:
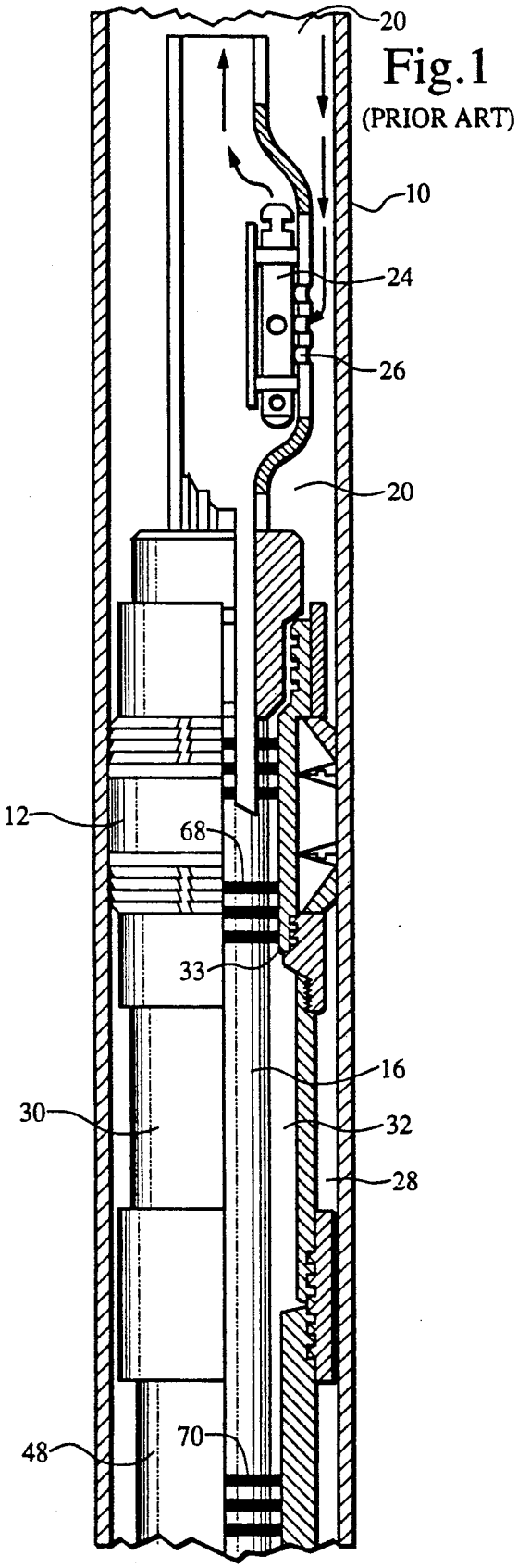
Fig.1 (PRIOR ART)
FIG. 1 is a partial cross-sectional view of a prior art system for chemically treating the production fluid in a well bore-hole only in the tubing string above the packer and providing apparatus for plugging the well if desired.
Figure 2:
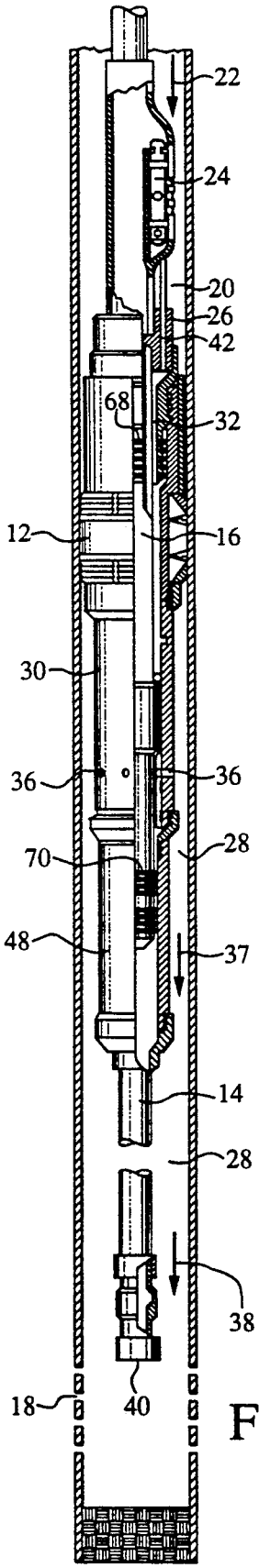
FIG. 2 is a partial cross-sectional view of the apparatus of the present invention that enables the production fluid to be treated in the vicinity of the producing perforations in the well casing below the packer as well as providing apparatus for plugging the well if desired.

FIG. 1 is a partial cross-sectional view of the lower portion of the well-bore illustrating the prior art and in which, in well casing (10), has been placed a packer (12). A tail pipe (14), shown in FIG. 2, is attached to the lower end of the packer and may extend in the vicinity of or below the perforations (18) in the well casing which allow the fluids being produced by the formations to enter the well casing (10) and pass upwardly through the production tubing (16) to the surface. Packer (12) prevents the formation fluids coming through the perforations (18) from entering the well casing (10) above the packer (12) in the space (20). Tubing string (16) is inserted through an opening in packer (12) and extends into sleeve extension (30) to carry the production fluids to the surface. Seals (68) and (70) prevent production fluids from entering the space (32) between the tubing string (16) and the walls (33) of the packer (12) to the area (20) above packer (12). Thus, casing (10) above packer (12) is protected from the corrosive effects of any fluid being produced by the perforations (18). However, the corrosive fluid could attack the production tubing (16) and therefore the well is chemically treated to neutralize the corrosive effects of the production fluid. This is accomplished by inserting the chemical treatment fluid in the well casing (10) from the surface under pressure so that it follows the arrows (22) (see FIG. 2) down the casing (10) and into a chemical injection valve (24). This valve is a one-way valve which allows the treatment fluid to enter, but will not allow any fluid to pass in the reverse direction through, the valve (24). Treatment fluid passes through a connection (26) where the fluid is injected into the production tubing (16) and travels up to the surface through the interior of the production tubing (16) thus neutralizing the corrosive effects of the production fluid traveling to the surface and protecting production tubing (16). However, as can be seen in FIG. 1, the space (28) below production packer (12) cannot be treated with the chemical treatment fluid because production packer (12) blocks access to the area (28) from the area (20) above packer (12). Thus, the well casing (10), the tail pipe (14) and the extensions (30) depending from the packer (12) are all subject to attack by the corrosive effects of the production fluids in the lower portion of the well casing below packer (12).

If it is desired to plug the well illustrated in FIG. 1, a plug can be set in the tail pipe (14) with the use of a wire-line in a well-known manner. When the production tubing (16) is then removed, the plug prevents the production fluid from traveling up past the packer (12) and the plug in tail pipe (14). All of the pipe left in the well below the packer (12) is subject to the corrosive effects of the production fluids.

The novel apparatus disclosed in FIG. 2 will not only allow the well to be plugged, but will also allow the production fluid to be treated in the area of the casing perforations (18) below the packer. Thus, as can be seen in FIG. 2, the packer (12) is again locked in place within well casing (10) in a well-known manner. Again, a tail pipe (14) is attached to the lower portion of the extension (30) that is attached to packer (12). Tubing (16) again is sealably inserted in and through packer (12) into the lower extension (30) of packer (12). The upper space (20) within casing (10) above packer (12) is sealed from the lower portion of the casing (10) below the packer (12) by the packer (12) itself and seals (68) and (70) on the tubing string (16). However, the treatment fluid (22) enters injection valve (24) as indicated previously. The output of the chemical injection valve is coupled to the connector (26) that has an output downwardly into passageway (42). Fluid passes through passageway (32) extending through packer (12) to extension (30) which is an injection sleeve having a port or ports (36) therein which allow the chemical treatment fluid to exit extension or injection sleeve (30) into the space (28) between the tail pipe (14) and well casing (10). The treatment fluid can then follow the path of arrows (37) and (38) to the base (40) of tail pipe (14) where the chemicals treat the fluids emerging from the perforations (18). The treated fluid can then enter the base (40) of tail pipe (14) and pass up to the surface through the interior of production tubing (16).

Figure 3:
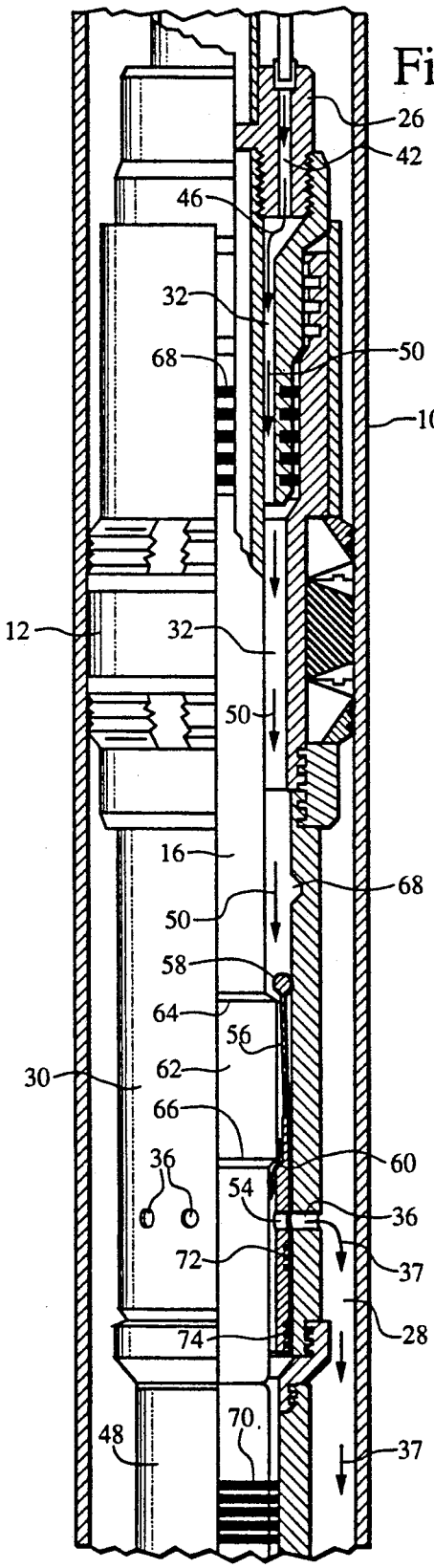
FIG. 3 is a first exploded view of a portion of the apparatus of FIG. 2 illustrating the details of the construction of the apparatus of the present invention.

The details of the novel apparatus are disclosed in the enlarged partial cross-sectional view illustrated in FIG. 3. As can be seen in FIG. 3, the chemical treatment fluid from injection valve (24) is coupled to the connector (26) in which a passageway (42) is formed extending downwardly to a second passageway (32) as being indicated by the arrow (46). The passageway (32) extends downwardly following the arrows (50) to at least one but preferably multiple injection ports (36) formed in the extension or injection sleeve (30). A shifting sleeve (52) has at least one port (54) therein that is in alignment with at least one port (36) in the injection sleeve (30). Thus, the fluid passes in the direction of arrows (50) through ports (54) and (36) into the space (28) as indicated by the arrow (37). In this manner, the production fluid below the packer (12) may be treated. Shifting sleeve (52) has an extension (56) with a flange or projection having a fourth shoulder (58) formed thereon. It also has a third shoulder (60) formed at the other end thereof. The production tubing (16) has a shifting collar (62) thereon having a second shoulder (64) at one end and a first shoulder (66) at the other end.

When the well is to be pulled and plugged, a plug can be set in the tail pipe (14) with the use of wire-lines as is well known in the prior art. When the production tubing (16) is then removed from the well, second shoulder (64) of shifting collar (62) engages fourth shoulder (58) of the shifting sleeve (52) thus moving the shifting sleeve (52) upwardly until the projection having shoulder (58) is received by groove (68). This action provides sufficient space to allow the shifting collar (62) to bypass or disengage with the projection having shoulder (58) of shifting sleeve (52). This action allows the production tubing (16) to be removed from the well and a plug set in tail pipe (28). In this case, the well is plugged and orifices (54) and (36) are no longer in alignment thus preventing fluid in the well casing (10) and space (28) from escaping to the interior of the extension or injection collar (30) below packer (12). In addition, as will be seen hereafter in relation to FIG. 4, seals (72) and (74) on shiftable sleeve (52) seal orifice (36) in injection sleeve (30) and prevent fluid in well casing (10) from entering space (32) between tubing string (16) and the inside walls of packer (12). The well, therefore, is completely plugged.

If it desired to reopen the well, the production tubing (16) is again lowered into the well in and through production packer (12) into injection sleeve (30) and extension (48). The first shoulder (66) on shifting collar (62) engages third shoulder (60) of shifting sleeve (52) thus moving the sleeve downwardly forcing projection (58) out of groove (68) (from the position shown in FIG. 4) so that the entire shifting sleeve (52) is moved downwardly with the production tubing (16). With the production tubing (16) extended into the packer (12), injection sleeve (30) and extension (48) as far as it can go, the shifting sleeve (52) now has at least one orifice (54) in alignment with at least one orifice (36) in injection sleeve (34). The plug is then pulled from the tail pipe and the well is now ready not only to produce but to be chemically treated again as necessary.

It will be noted that seals (68) in the upper portion of the production tubing (16) at the packer prevent any fluid in the upper portion of the casing (10) above packer (12) to enter into passageway (32). In like manner, seals (70) at the lower end of the production tubing (16) prevent fluid in tail pipe (14) from entering into passageway (32). Further, first and second spaced annular seals (72) and (74) are both on the same side of orifice (36) as shown in FIG. 3 when the shifting sleeve (52) is in its first position then allowing treatment fluid to pass freely through orifice (36). However, when the shifting sleeve (52) is moved upwardly from its first position as shown in FIG. 3 to the second position shown in FIG. 4 where the projection or flange (58) is engaged in groove (68), the seals (72) and (74) are on respective sides of the at least one injection port (36) to prevent a transfer of fluid from the space (28) to the passageway (32), or in reverse, when the tubing means is removed from the casing.

Figure 4:
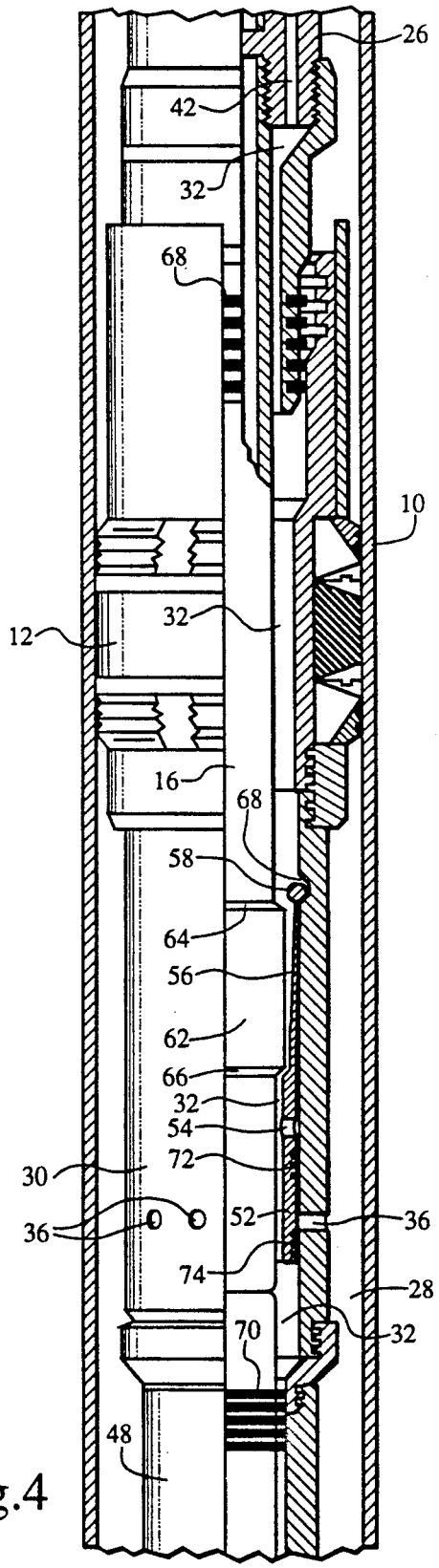
FIG. 4 is a second exploded view of a portion of the apparatus of FIG. 2 illustrating the shifting sleeve in its second position to seal the orifice of the injection sleeve.

FIG. 4 is an enlarged partial cross-sectional view of the novel apparatus illustrating the sealing position of shifting sleeve (52) with projection (58) in groove (68) and the tubing string (16) is being removed. Note how seals (72) and (74) are on respective sides of injection orifice or port (36) to seal port (36).

Thus there has been disclosed a novel apparatus which allows a well to be chemically treated in the vicinity of the producing formations and perforations in the well casing and yet allow the well to be plugged and unplugged as necessary. The packer is set in place in the casing and has within it an injection sleeve and a shiftable sleeve having aligned orifices in a first position of the shifting sleeve. In that position, treatment fluid can pass through a passageway created by the space between the packer and the production tubing, through the aligned orifices and into the space below the packer in the vicinity of the perforations in the well casing where the production fluids are being generated. Thus the entire lower portion of the well below the packer including the vicinity of the perforations where the production of fluid is being generated is treated. When it is desired to plug the well, a plugging device is set in the tail pipe and the production tubing is removed from the well. When the production tubing is moved upwards, the shifting collar on the production tubing engages the flange or projection on the shiftable sleeve effectively sliding the shiftable sleeve up to its second position until it has seals on each side of the injection port in the injection sleeve to seal off the injection ports. In that position, the flange or projection on the upper end of the slidable or shiftable sleeve engages and is received in the groove in the injection sleeve allowing the tubing with the shifting collar to be completely removed from the well. Thus, in its closed position, the flange or projection on the shifting sleeve snaps into the recess or groove in the injection sleeve which releases the shifting collar and allows the tubing to be removed. The tail pipe plugging device and the closed injection sleeve ports will contain any pressure above or below the packer. When the production tubing assembly is reinstalled in the packer, the shifting collar on the production tubing will engage a shoulder on the shifting sleeve and the shifting sleeve will be shifted again to its first position where its orifice is aligned with at least one orifice in the injection sleeve so that production and injection of the chemical treatment fluid can once again take place when the tail pipe plugging device is removed. Thus the invention has been described in connection with a preferred embodiment. This description is not intended to limit the scope of the invention to the particular form set forth, but, on the contrary, it is intended to cover such alternatives, modifications and equivalents as may be included within the spirit and scope of the invention as defined in the appended claims.

I claim:

1. A system for chemical fluid treatment of production fluids as they are produced by perforations in a well-bore casing and carried to the surface, said system comprising:

means for blocking production fluid flow in said casing from said perforations, said blocking means having a wall therein forming an opening therethrough;

at least one orifice extending through said blocking means wall from the surface side to the casing perforations side;

tubing means inside said casing and sealably coupled to and slidably extending through said blocking means opening for enabling said production fluid to flow from said perforations through said tubing means to said surface, said tubing means and said blocking means preventing said production fluids below said blocking means from contacting said well-bore casing above said blocking means;

an injection sleeve attached to and extending below said blocking means between said tubing string and said casing and forming a first passageway between said tubing string and said injection sleeve that is sealed at one end and in fluid cooperation with the orifice in said blocking means wall at the other end, and a second passageway between the injection sleeve and said casing; and selectively closeable orifice means associated with said injection sleeve for allowing chemical treatment fluid to flow from the surface through said blocking means orifice, said first passageway, said closeable orifice and said second passageway to the area of said perforations for treatment of the production fluid below said blocking means, said treated fluid being carried to the surface through said tubing means.

2. A system as in claim 1 further comprising:

a shifting sleeve concentric with the inside circumference of said injection sleeve and movable between first and second positions; and an orifice in said shifting sleeve in alignment with the orifice in said injection sleeve in said first position such that chemical treatment fluid may flow from said first fluid passageway through said shifting sleeve orifice and said aligned injection sleeve orifice to the second passageway and the production fluids from said perforations in the area below said blocking means.

3. A system as in claim 2 further comprising:

a shifting collar on said tubing means;

first means on such shifting collar for moving said shifting sleeve to its first position aligning said injection sleeve orifice and said shifting sleeve orifice when said tubing means is inserted in said blocking means and said injection sleeve; and second means on said shifting collar for moving said shifting sleeve to its second position blocking said injection sleeve orifice when said tubing means is withdrawn from said blocking means and said injection sleeve.

4. A system as in claim 3 further including:

first and second shoulders on said shifting collar;

third and fourth shoulders on said shifting sleeve;

said first shifting collar shoulder engaging said third shifting sleeve shoulder when said tubing means is inserted in said injection sleeve to move said shifting sleeve to its first position aligning the orifices in the shifting sleeve and injection sleeve; and said second shifting collar shoulder engaging said fourth shifting sleeve shoulder when said tubing means is withdrawn from said injection sleeve to move said shifting sleeve to its second position blocking said injection sleeve orifice.

5. A system as in claim 4 further including:

at least one projection forming said fourth shoulder on said shifting sleeve; and a projection receiving groove on the inner surface of said injection sleeve for receiving said projection in said second position of said shifting sleeve so as to create space sufficient to enable said shifting collar to pass by said projection when said tubing means is removed from and inserted in said injection sleeve, said projection being forced out of said groove when said shifting sleeve is moved to said first position.

6. A system as in claim 5 further including first and second spaced annular sealing means on respective sides of said orifice in said shifting sleeve in contact with said injection sleeve, one of said first and second spaced sealing means being on each side, respectively, of said orifice in said injection sleeve when said shifting sleeve is in said second position to seal said injection sleeve orifice and prevent fluid transfer between the interior and the exterior of said injection sleeve when said tubing means is removed from said casing.

7. A system as in claim 6 further including:

a tail pipe attached to and extending from said injection sleeve; and a plugging device inserted in said tail pipe to seal said injected sleeve and prevent fluid transfer between the interior and the exterior of said tubing means so as to entirely plug said well.

8. A system as in claim 7 further including upper and lower spaced seal assemblies on said tubing means for engaging the walls of said blocking means opening to prevent said production fluid from entering the space first passageway between said tubing means and said injection sleeve.

9. A method of chemically treating production fluid from perforations in a well casing in a bore-hole comprising the steps of:

blocking production fluid flow in said casing from said perforations with a packer having a wall therein with an opening therethrough;

conducting the production fluid from the perforations to the surface of the bore-hole through a production tubing sealably and slidably extending through said opening in said packer;

receiving chemical treatment fluid from said surface through an orifice in said packer wall;

coupling the fluid from said orifice to a first passageway formed by an injection sleeve extended below said packer between said production tubing and said casing, said first passageway being formed between said production tubing and said injection sleeve, said sleeve being sealed at the lower end and surrounding said production tubing; and coupling said treatment fluid through a selectively closeable orifice in said injection sleeve to a second passageway between the injection sleeve and said casing for treating the production fluid in the vicinity of the perforations.

10. A method as in claim 9 further including the steps of:

opening and closing said selectively closeable orifice by shifting a sleeve having a second orifice therein between first and second positions, and shifting sleeve being concentric with the inside circumference of said injection sleeve; and passing the treatment fluid through said first and second orifices when said shifting sleeve is moved to said first position in which the first and second orifices are in alignment and stopping said treatment fluid flow when said shifting sleeve is moved to a second position in which the first and second orifices are out of alignment.

11. A method as in claim 10 wherein the step of injecting chemical treatment fluid further comprises the steps of:

forcing said second orifice in alignment with said first orifice to enable chemical treatment of said production fluid below said packer by moving said shifting sleeve to said first position when said production tubing is inserted in said opening in said packer to enable said chemical treatment to occur; and forcing said second orifice out of alignment with said first orifice to close said first orifice by moving said shifting sleeve to said second position when said production tubing is removed from said opening in said packer.

12. A method as in claim 11 further including the step of preventing production fluid leakage through said first orifice to said passageway by placing seals in said shifting sleeve on either side of said first orifice in said injection sleeve when said shifting sleeve is in said second position.

13. A packer for enabling blocking of a bore-hole casing, allowing a production tubing to slidably extend into an opening in said packer for recovering production fluid from said perforations in said casing, and enabling treatment of said production fluid in the area of said perforations with chemical fluids, said packer comprising:

a center portion having a fluid carrying orifice extending therethrough and being positioned in said bore-hole casing at a predetermined depth;

a substantially cylindrical chemical injection sleeve inside of said casing, attached to and extending downwardly from said packer center portion and surrounding said production tubing to form a first passageway, said first passageway having a fluid-tight seal at the bottom thereof;

an orifice in said injection sleeve for receiving said chemical treatment fluids from said packer fluid carrying orifice and said first passageway inside of said of said injection sleeve and passing the treatment fluids to the outside of said injection sleeve; and means associated with said packer and said injection sleeve for selectively closing said orifice when said well is to be blocked and selectively opening said orifice when said production fluids are to be treated.

14. A packer as in claim 13 wherein said means for opening and closing said injection sleeve orifice further comprises:

a slidable sleeve concentrically arranged on the inside surface of said injection sleeve for movement between a first and second position;

at least one recess formed on the inner wall of said injection sleeve;

at least one resilient projection forming a part of one end of said shifting sleeve and resting in said recess when said shifting sleeve is in said second position and resting on said inner wall of said injection sleeve when said shifting sleeve is any position other than said second position for use in moving said shifting sleeve to said second position;

a second projection forming a part of the other end of said shifting sleeve for use in moving said shifting sleeve to its first position; and an orifice in said shiftable sleeve, said shifting sleeve orifice and said injection sleeve orifice being in alignment only when said shifting sleeve is in said first position for coupling treatment fluid to said production fluid in the area of said perforations.

15. A chemical injection system for a well-bore comprising:

a production casing;

perforations in said casing for receiving production fluids from said well-bore;

a production packer positioned in said casing above said perforations and having an opening therein;

a fluid path through said production packer;

a tubing string for slidable insertion in the packer opening;

a first sleeve attached to the lower end of said packer opening and forming a first passageway between said sleeve and said tubing string, said first passageway being in fluid transfer relationship with said fluid path through said production packer;

at least one first orifice in said first sleeve;

a second sleeve slidably concentric with and abutting the inside surface of said first sleeve;

at least one second orifice in said second sleeve for movement between a first position in aligned relationship with said first orifice for allowing chemical treatment fluids entering the first passageway between said first sleeve and said tubing string to mix with said production fluid and a second position in a non-aligned relationship with said at least one first orifice to prevent chemical treatment fluids from mixing with said production fluids;

first and second spaced seals on said second sleeve for movement between a first position remove from said at least one first orifice and a second position for sealing said at least one first orifice from said chemical treatment fluid;

a recess on the inner surface of said first sleeve;

a spring-loaded first shoulder integrally formed with said second slidable sleeve for latching engagement with said recess;

a second shoulder on said second slidable sleeve; and a collar on said tubing string for engaging said second shoulder on said second sleeve when moving into said bore-hole for causing said first and second orifices to align and allow chemical treatment fluids to pass therethrough and for engaging said first shoulder when moving out of said bore-hole to move said second sleeve and seal said one first orifice.

* * * * *